US005123565A

United States Patent [19]

Majewski

[11] Patent Number: 5,123,565

[45] Date of Patent: Jun. 23, 1992

[54] ATTACHMENT FOR PAINT CAN

[76] Inventor: Joseph Majewski, 130 Clifton Pl., Syracuse, N.Y. 13206

[21] Appl. No.: 735,268

[22] Filed: Jul. 24, 1991

[51] Int. Cl.[5] ..... B65D 25/00

[52] U.S. Cl. ..... 220/701; 220/731; 220/733; 220/354; 220/287; 220/315

[58] Field of Search ..... 220/90, 354, 287, 315

[56] References Cited

U.S. PATENT DOCUMENTS

| | | | |
|---|---|---|---|
| 2,321,492 | 6/1943 | Kinney | 220/90 |
| 2,703,670 | 3/1955 | Voight | 220/287 |
| 2,873,881 | 2/1959 | Nichols | 220/90 |
| 2,885,108 | 5/1959 | Donoghue | 220/90 |
| 3,141,567 | 7/1964 | Schearer | 220/287 |
| 4,150,763 | 4/1979 | Simpson | 220/287 |
| 4,163,503 | 8/1979 | McKinnon | 220/287 |
| 4,198,040 | 4/1980 | Colasent | 220/287 |
| 4,911,319 | 3/1990 | Dejean | 220/90 |
| 4,928,846 | 5/1990 | Murrin, Jr. | 220/90 |

FOREIGN PATENT DOCUMENTS

| | | | |
|---|---|---|---|
| 147646 | 8/1952 | Australia | 220/90 |
| 4912 | 3/1888 | United Kingdom | 220/354 |

*Primary Examiner*—Stephen Marcus
*Assistant Examiner*—S. Castellano
*Attorney, Agent, or Firm*—Katherine McGuire

[57] ABSTRACT

Attachment for a paint can substantially eliminates accumulation of paint within the groove encircling the rim of the paint can. A rigid plate having planar top and bottom surfaces includes a central opening. A first set of spiked pegs are mounted to and extend normal from the bottom surface of the plate. The pegs are equally, annularly spaced such that they may be aligned within the groove of the can. The plate may then be forced down upon the can whereupon the pegs pierce the bottom of the groove to form holes therein. The plate thus lies in tight, covering relation over the rim of the can preventing paint from entering the groove. When the plate is removed from the can, the holes formed in the groove allow paint which thereafter collects in the groove to pass therethrough and back into the can. A second set of pegs are provided to alternately accomodate a different size paint can.

5 Claims, 2 Drawing Sheets

ATTACHMENT FOR PAINT CAN

BACKGROUND OF THE INVENTION

The present invention relates to apparatus for minimizing paint accumulation along and in the groove of the rim of paint cans. It has been every painter's experience to have paint collect and accumulate in the groove of the rim of a paint can caused by either pouring paint from the can and/or wiping the paint brush against the inside of the rim to remove excess paint therefrom. Stirring of the paint while in the can, usually with a stick, also may cause the paint to rise above the level of the rim and enter the groove. The problem thus arises when it is time to re-attach the lid to the can should there be un-used paint left in the can needed to be properly stored in an air-tight container to await further uses thereof. With accumulated paint in the groove encircling the rim of the can, the forcing down of the flange encircling the perimeter of the lid into the groove of the can causes the paint in the groove to spill out and down the sides of the can presenting a very messy situation besides wasting good paint.

It is therefore a principal object of the present invention to provide apparatus which substantially eliminates paint from collecting and accumulating in the groove of the rim of a paint can.

It is a further object to provide apparatus which is adapted to be attached and removed from the rim of a paint can with a minimum of effort and which reduces occurances of paint spillage thereby being conducive to a clean environment.

It is another object to provide apparatus which is adapted to be alternately used on at least two different sized paint cans.

It is yet a further object to provide apparatus which is relatively inexpensive and easy to manufacture and otherwise economically attractive.

Other objects will in part be obvious and in part appear hereinafter.

SUMMARY OF THE INVENTION

In accordance with the foregoing objects, the invention comprises a rigid, planar plate of substantially circular outline and including a central, concentric opening. When the plate is positioned on top of the rim of an open can of paint with the central opening lying substantially concentric with the open paint can top, the central opening in the plate reveals and provides access to the interior of the can while the outer periphery of the plate extends beyond the sides of the paint can.

A plurality of spiked pegs are mounted to and extend normal to a first planar surface of the plate, the pegs being annularly spaced in the area between the central opening and the outer periphery of the plate. The pegs are aligned to a specific size paint can whereby the spiked ends thereof may be forcefully pressed within the circular groove of the paint can rim thereby piercing the bottom surface of the groove with the pegs. In the fully inserted position of the pegs within the groove, the plate lies in tight, covering relation on the rim of the can above the groove thereby preventing any paint from gathering therein which may occur, for example, when stirring the paint by passing a stick into the paint through the central opening of the plate.

Upon removal of the pegs from the groove and hence the plate from the can, holes formed by the pegs remain in the bottom of the groove. Any paint which thereafter accumulates in the groove through pouring paint from the can, for example, may therefore freely pass through the holes and back into the can.

In the preferred embodiment of the invention, a second set of spiked pegs are concentrically and annularly spaced with respect to the first set of pegs yet are aligned to fit a different size paint can, the one apparatus thereby alternately accommodating the two usual sizes of paint cans on the market today, although the invention may of course be made to fit any size paint cans.

DETAILED DESCRIPTION

Figure 1:
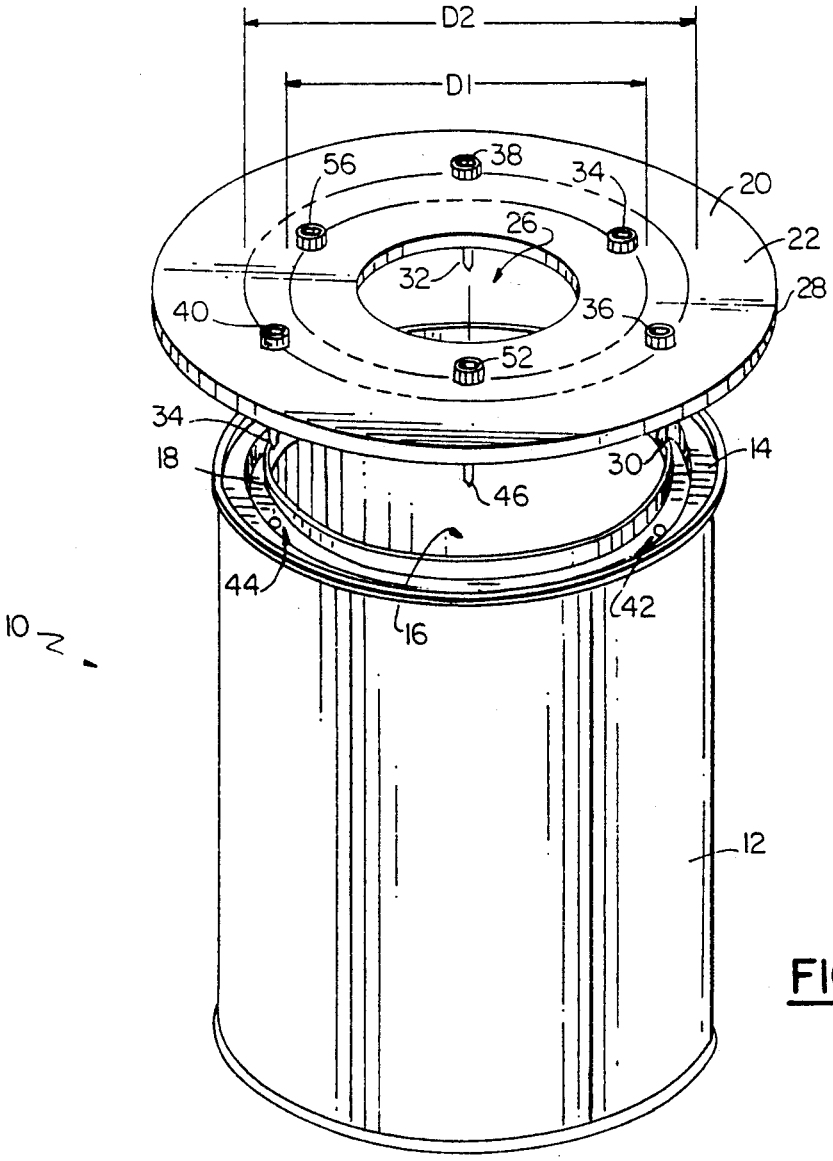
FIG. 1 is a perspective view of the invention following removal thereof from the rim of a conventional paint can.

Referring now to the drawings, there is seen in FIG. 1 a conventional paint can 10 having cylindrical body 12 including a circular rim 14 defining an open top 16. Rim 14 is seen to include annular groove 18 into which the annular flange of a paint can lid (not shown) is removably engaged thereby securing the lid to the can to provide an air-tight seal which protects the integrity of the paint within the can. When the lid is removed from the can, certain procedures associated with the painting process invariably lead to accumulation of the paint within groove 18. Such procedures include initial stirring of the paint where the stirring action causes the paint to rise above the level of the rim 14 and enter groove 18. This also occurs when the can is tipped for pouring the paint into a second container and when a paint brush, after having been dipped into the paint, is wiped against the inside of rim 14.

The present invention provides apparatus which may be removably attached to the rim 14 of paint can 10 to substantially reduce accumulation of paint within groove 18. In particular, the invention is characterized by a rigid, annular plate 20 having a top planar surface 22 and bottom planar surface 24 including a central opening 26 which is smaller in diameter than the diameter of the paint can opening 16. When plate 20 is mounted atop rim 14 in the intended manner as will be described more fully below, opening 26 is concentric with paint can opening 16 and the outer, circular perimeter 28 of plate 20 extends outwardly beyond paint can body 12 (this feature seen most clearly in the elevational view of FIG. 4).

Figure 2:
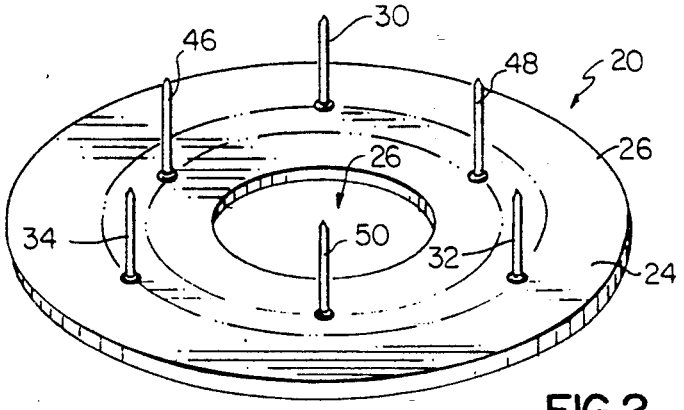
FIG. 2 is a perspective view of the invention inverted from the view of the invention seen in FIG. 1.

As seen most clearly in FIG. 2, the bottom surface 24 of plate 20 includes a first, outer set of spiked pegs 30, 32 and 34 which are equally, annularly spaced about plate 20 along an imaginary circle having a diameter $D_2$ which is concentric with and lies between central opening 26 and outside perimeter 28. Pegs 30, 32 and 34 are allen-type screws which are threaded only adjacent the heads 36, 38 and 40 thereof, respectively, and which are mounted to plate 20 by passing through threaded holes formed therein at the locations shown and described, pegs 30, 32 and 34 extending normal from bottom surface 24.

Figure 3:
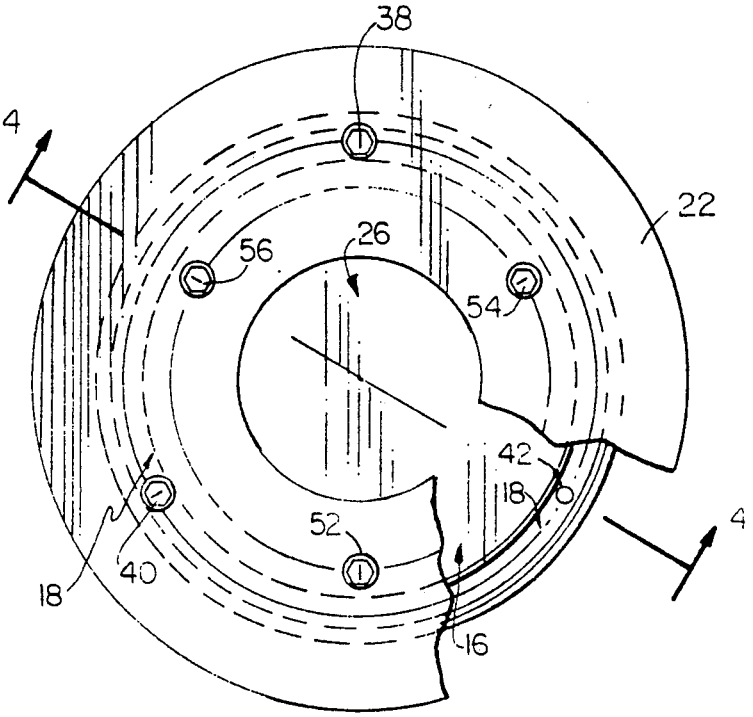
FIG. 3 is a top plan view of the invention mounted to the rim of a paint can in the intended manner with a portion of the invention shown broken away.
Figure 4:
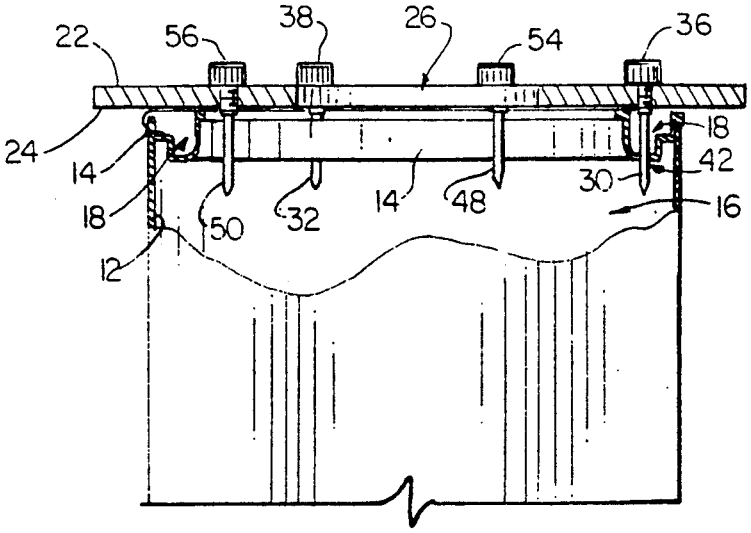
FIG. 4 is a side, elevational view taken generally along the line 4-4 in FIG. 3 with portions of the paint can shown broken away.

The first set of pegs 30, 32 and 34 are mounted about the circle having diameter $D_2$ which is substantially equal to the diameter of the center-line of groove 18 within rim 14 of paint can 10. This is so that the sharp, free ends of pegs 30, 32 and 34 may be positionally aligned within groove 18 as seen in FIGS. 1 and 4. To removably attach plate 20 to can 10, plate 20 is forcefully pressed down upon rim 14, either manually or with a hammer, whereupon pegs 30, 32 and 34 pierce the bottom surface at the center-line of groove 18 forming holes therein, two such holes 42 and 44 formed by pegs 30 and 34, respectively, being seen in FIGS. 1, 3 and 4.

With pegs 30, 32 and 34 extending through the bottom surface of groove 18, plate 20 is pushed downwardly upon rim 14 until plate bottom surface 24 firmly abuts rim 14 as seen in FIG. 4. In this position, plate 20 entirely covers rim 14, including groove 18. To stir the paint within the can, a stick may be passed through opening 26. The stirring action tends to raise the level of paint within the can; however, since plate 20 lies in tight, covering relation to rim 14 and groove 18, no paint will rise above rim 14 to enter groove 18. A relatively small paint brush may also be passed through opening 26, dipped into the paint and wiped along the edge of plate 20 defining opening 26, again with no paint entering groove 18. If paint needs to be poured from can 10, plate 20 may be lifted therefrom thereby revealing the holes in groove 18 left by pegs 30, 32 and 34. Any paint which may thereafter collect in groove 18, for example be tilting can 10 to pour paint therefrom, freely passes through the holes in groove 18 to re-enter the cavity of can 10. With hardly any paint being able to accumulate in groove 18, the lid of the can may be thereafter replaced upon rim 14 with no paint seeping out from groove 18 to drip along the outside surface of paint can body 12.

It may thus be appreciated that plate 20 works to keep paint from accumulating in the groove 18 when both in the attached and removed condition with relation to paint can 10. The plate 20 may be removed from can 10 at any time following the formation of the holes in the bottom surface of groove 18 since any paint collected therein will pass through the holes and back into the can, although it may be desired to keep plate 20 in place on rim 14 during stirring of the paint, for example.

It will be noticed that a second, inner set of spiked pegs 46, 48 and 50 are equally, annularly spaced about a circle having a diameter $D_1$ concentric with and smaller than diameter $D_2$ of the first set of pegs. Pegs 46, 48 and 50 are also allen-type screws threaded adjacent the heads 52, 54 and 56, respectively, and which mount to plate 20 by passing through threaded holes which are preferably spaced in the area about the circle having diameter $D_1$ between respective pegs 36, 38 and 40 as seen in the figures. Pegs 52, 54 and 56 are provided to fit plate 20 to a paint can of smaller size than can 10 and having a rim groove with a diameter substantially equal to diameter $D_1$. When plate 20 is attached to rim 14 of can 10 as seen in FIG. 4, pegs 36, 38 and 40 align themselves within groove 18 while the inner set of pegs 52, 54 and 56 lie within can opening 16 adjacent rim 14. Although not shown, when pegs 52, 54 and 56 are fit within the groove of a smaller paint can as described above, the outer set of pegs 36, 38 and 40 lie outside the paint can adjacent the body of the can by the rim. It may thus be appreciated that plate 20 alternately accomodates two different sized paint cans. It may also be realized that the pegs may be mounted about any size circle between opening 26 and outer perimeter 28 to accomodate any size paint can. Although two separate sets of pegs having three pegs each have been described in accordance with the invention herein, it is of course possible to have a varied number of pegs and sets thereof mounted about circles of differing diameters to accomodate paint cans of differing diameters.

What is claimed is:

1. Apparatus for removable attachment to a paint can having a circular rim with a groove having a center line of predetermined diameter disposed therein defining an open top, said apparatus comprising:

a) a rigid plate of a predetermined outline having a top surface and an opposite, substantially planar bottom surface, said plate having a first plurality of threaded holes of predetermined diameter extending therethrough from said top surface to said bottom surface in a direction normal to the plane in which said bottom surface lies, said first plurality of holes being annularly spaced about a first circle having a diameter equal to said predetermined diameter of the groove's center line; and b) a first plurality of pegs having first and second ends, said first ends being of a diameter larger than said predetermined diameter of said holes, said second ends being sharp with a portion of said pegs between said first and second ends being threaded adjacent said first ends whereby said pegs are removably mounted to said plate by passing said second ends through said holes and engaging said threads on said pegs with said threaded holes thereby securing said pegs to said plate with said peg first ends abuting said plate top surface and said second ends extending downwardly from said plate bottom surface in a direction normal to said bottom surface plane, said pegs thereby positioned about said first circle whereby said plate may be positioned over said paint can open top with said sharp, second ends positioned within said grove, said plate being forced downwardly upon said can such that said sharp, second ends pierce said groove thereby forming holes therein, said bottom surface of said plate lying in tight, covering relation over said rim and said groove.

2. The invention according to claim 1 and further comprising a central opening in said plate.

3. The invention according to claim 2 wherein said predetermined outline and said central opening are circular and said first circle is concentric with and lies between said outline and said opening.

4. The invention according to claim 1 wherein said first plurality of pegs are substantially equally spaced about said circle.

5. The invention according to claim 1 and further comprising a second plurality of threaded holes of predetermined diameter extending through said plate from said top surface to said bottom surface in a direction normal to said planar bottom surface, said second plurality of holes being annularly spaced about a second circle having a second diameter larger than and concentric with said diameter of said first circle, and further comprising a second plurality of pegs having first and second ends, said first ends being of a diameter larger than said predetermined diameter of said second plurality of holes, said second ends of said second plurality of pegs being sharp with a portion of said second plurality of pegs between said first and second ends being threaded adjacent said first ends thereof whereby said second plurality of pegs are removable mounted to said plate by passing said second ends of said second plurality of pegs through said second plurality of holes and engaging said threads of said second plurality of pegs with said second plurality of threaded holes thereby securing said second plurality of pegs to said plate with said first ends of said second plurality of pegs abutting said plate top surface and said second ends of said second plurality of pegs extending downwardly from said plate bottom surface in a direction normal to said bottom surface plane, said second plurality of pegs thereby lying about said second circle whereby said plate may be positioned over a second paint can having a circular rim with a groove having a centerline of a diameter equal to said second diameter, said sharp, second ends of said second plurality of pegs positionable within said groove of said second paint can whereby said plate may be forced downwardly upon said second paint can whereupon said sharp, second ends of said second plurality of pegs pierce said groove of said second can thereby forming holes therein with said second plurality of pegs extendable through said holes in said groove of said second can until said plate bottom surface lies in abutting, covering relation on said second can rim completely covering said second can groove and said first plurality of pegs extending within said second paint can.

* * * * *